US009079701B2

(12) United States Patent
Hettinger et al.

(10) Patent No.: US 9,079,701 B2
(45) Date of Patent: Jul. 14, 2015

(54) PNEUMATIC DOSING UNIT AND PNEUMATIC DOSING SYSTEM

(71) Applicant: Buerkert Werke GmbH, Ingelfingen (DE)

(72) Inventors: Christoph Hettinger, Ingelfingen (DE); Volker Lienhardt, Kupferzell/ OT Westernach (DE); John Van Loon, Vlaardingen (NL)

(73) Assignee: BUERKERT WERKE GMBH, Ingelfingen (DE)

( * ) Notice: Subject to any disclaimer, the term of this patent is extended or adjusted under 35 U.S.C. 154(b) by 56 days.

(21) Appl. No.: 13/866,598

(22) Filed: Apr. 19, 2013

(65) Prior Publication Data

US 2013/0277398 A1 Oct. 24, 2013

(30) Foreign Application Priority Data

Apr. 20, 2012 (DE) ..... 20 2012 003 948 U

(51) Int. Cl.
*B65D 37/00* (2006.01)
*B65D 83/00* (2006.01)
*F04B 43/073* (2006.01)

(52) U.S. Cl.
CPC ..... *B65D 83/0055* (2013.01); *F04B 43/073* (2013.01)

(58) Field of Classification Search
CPC ..... B65B 3/26; B65D 83/0055; F04B 43/073
USPC ..... 138/30; 141/117, 119, 128, 236, 244, 141/311 A; 220/723; 222/207, 133, 253, 222/444, 71, 72, 209, 214, 309, 333, 334, 222/434, 440, 447, 450, 504; 137/613, 137/625.3, 863; 251/61.1; 417/521
See application file for complete search history.

(56) References Cited

U.S. PATENT DOCUMENTS 2,529,028 A * 11/1950 Landon ..... 222/57
3,490,470 A * 1/1970 Kraft ..... 135/34.2

(Continued)

FOREIGN PATENT DOCUMENTS

DE 102008028772 A1 12/2009
DE 102008028772 1/2012

OTHER PUBLICATIONS

German Search Report for application No. 20 2012 003 948.2 issued on Jan. 25, 2013.

*Primary Examiner* — Frederick C Nicolas
*Assistant Examiner* — Bob Zadeh
(74) *Attorney, Agent, or Firm* — Lowe Hauptman & Ham, LLP

(57) ABSTRACT

A pneumatic dosing unit includes a housing having a first housing part for a pump-fluid receiving pump channel and a second housing part for dosing-fluid receiving channels. A cavity is formed between the housing parts. A flexible diaphragm is clamped between the housing parts and divides the cavity into a pump chamber and a dosing chamber that are fluidically separated from each other. At least one feed channel and at least one drain channel in the second housing part lead to the dosing chamber and start from the dosing chamber, respectively. Diaphragm valves in the feed channel and in the drain channel are spaced apart from the pump chamber and the dosing chamber and are controllable via control channels in the first housing part. The diaphragm and the diaphragm valves are arranged in such a way that dosing fluid does not come into contact with the first housing part.

11 Claims, 3 Drawing Sheets

(56) References Cited

U.S. PATENT DOCUMENTS

| | | | | |
|---|---|---|---|---|
| 3,862,708 | A | 1/1975 | Waxlax | |
| 4,274,452 | A | 6/1981 | Schmitt | |
| 4,858,883 | A * | 8/1989 | Webster | 251/61.1 |
| 4,917,348 | A | 4/1990 | Phallen et al. | |
| 4,974,754 | A * | 12/1990 | Wirz | 222/207 |
| 5,088,515 | A * | 2/1992 | Kamen | 137/15.17 |
| 5,593,290 | A * | 1/1997 | Greisch et al. | 417/478 |
| 6,065,940 | A * | 5/2000 | Fleischer et al. | 417/63 |
| 7,726,511 | B2 * | 6/2010 | Beall | 220/723 |
| 7,967,022 | B2 * | 6/2011 | Grant et al. | 137/100 |
| 8,602,070 | B2 * | 12/2013 | Hansen | 141/117 |
| 8,672,645 | B2 * | 3/2014 | Lin | 417/395 |
| 2004/0136843 | A1 * | 7/2004 | Jahn et al. | 417/395 |

* cited by examiner

PNEUMATIC DOSING UNIT AND PNEUMATIC DOSING SYSTEM

CROSS REFERENCE TO RELATED APPLICATION

This application claims the priority of German Patent Application No. 20 2012 003 948.2, filed on Apr. 20, 2012 in the DPMA (German Patent and Trade Mark Office), which is incorporated herein by reference in its entirety.

FIELD OF THE INVENTION

The present invention relates to a pneumatic dosing unit having a multipart housing in which a cavity is formed that is divided by a flexible diaphragm into a pump chamber and a dosing chamber.

BACKGROUND

For precise dosing of extremely high-quality media, for example in the pharmaceuticals sector, the complex and expensive dosing units must be cleaned and sterilized with great effort. This is worthwhile primarily in the case of large sample quantities.

In such dosing units, pump fluid, especially air, is alternatingly blown in the pump chamber and drawn out therefrom, such that the diaphragm is moved between two end positions and the volume of the dosing chamber facing the pump chamber thus increases and decreases. This results in a diaphragm pump via which the dosing fluid flows out of or is drawn into the dosing unit in very precise quantities. The dosing chamber is fluidically connected or disconnected, on the feed side and on the drain side, with the feed and the drain, respectively, by at least one diaphragm valve each. The diaphragm valves are controlled, for example, by a pneumatic valve that controls the application of pressure to the diaphragm on the side facing the dosing fluid.

From DE 10 2008 028 772 A1, a pneumatic dosing unit is known in which the quantity of a dosing fluid is controlled by the opening time of a diaphragm valve. A second diaphragm valve is provided downstream of the diaphragm valve, which second diaphragm valve, however, can be circumvented by a bypass channel of a defined size. When the second diaphragm valve is closed, the dosing occurs in that fluid flows through the precisely dimensioned bypass channel. The second diaphragm valve serves to suck the line between the valves empty for a short time after the first diaphragm valve is closed. For a precise dosing of the fluid, it is necessary to know the flow speed of the fluid.

SUMMARY

The object of the present invention is to create a simply constructed dosing unit that efficiently ensures economical use also in the case of small, less high-quality media, that is, dosing fluids. Further, the dosing unit is to be very easily controllable and to dose the fluid precisely.

The pneumatic dosing unit according to the invention comprises a multipart housing having a first housing part in which at least one pump-fluid receiving pump channel is formed, and a second housing part in which dosing-fluid receiving channels are formed, a cavity formed between the housing parts, a flexible diaphragm clamped between the first and the second housing parts and dividing the cavity into a pump chamber and a dosing chamber that are fluidically separated from each other, at least one feed channel and at least one drain channel in the second housing part leading to the dosing chamber and starting from the dosing chamber, respectively, diaphragm valves in the feed channel and in the drain channel that are spaced apart from the pump chamber and the dosing chamber and that are controllable via control channels in the first housing part, and the diaphragm and the diaphragm valves being arranged in such a way that dosing fluid does not contact the first housing part.

The diaphragm valves are spaced apart from the pump and the dosing chamber, so are not part of same.

In the dosing unit according to the present invention, the first housing part, which is usually more complex to produce, does not come into contact with the dosing fluid and is thus not contaminated for further measurements with other dosing fluid. This means only the second housing part must be cleaned, or, what makes the dosing unit according to the present invention still more economical, only the second housing part must be executed as a disposable item. Contrary to DE 10 2008 028 772 A1, in the dosing unit according to the present invention, the fluid to be dosed is drawn into its own dosing chamber, which can be closed off outwardly by two separate diaphragm valves.

In this way, the dosing unit according to the present invention permits the dosing quantity to be determined not necessarily via the opening time of the upstream diaphragm valve. Rather, the dosing chamber can be filled more or less often and more or less quickly via a frequency control only to produce minute units of fluid to be dosed.

In this context, it is of further advantage if, exclusively in the first housing part, pump channels and/or control channels, and/or exclusively in the second housing part, dosing-fluid receiving channels are formed, such that pump fluid and dosing fluid each flow in their own housing part and cannot come into contact with the respective other housing part.

The preferred embodiment provides that, in the case of a disassembled second housing part, all channels or spaces opening in at the contact surface facing the second housing part are sealed, especially by the diaphragm or the multiple diaphragms, such that, when the second housing part is exchanged, an inadvertent contamination through open channels or chambers in the first housing part is excluded.

To further reduce the costs of the dosing unit, the diaphragm separating the pump and the dosing chamber from each other and the diaphragm of the diaphragm valve in the feed channel and in the drain channel are a shared, i.e. common part. This means the diaphragm separating the pump and the dosing chamber from each other also extends into the diaphragm valves in the feed and in the drain channels and consequently has sections that protrude into said diaphragm valves.

If the second housing part is an injection molded part manufacturable without a cross-slide, e.g. composed of plastic, said part may be manufactured very economically, which makes it attractive as a disposable item. This means the injection molded part has no undercut in the demolding direction of the two injection mold halves used when injection molding.

Furthermore, all channels and chambers on the injection molded part are manufactured when injection molding, that is, without mechanical or other finishing work.

A preferred possibility for how the channels or chambers in the second housing parts are manufactured consists in that the second housing part has two opposite end faces. One of said end faces faces the first housing part and forms, so to speak, the joint face between the two housing parts. There are longitudinal channels leading from one to the opposite end face, and transverse channels connecting the longitudinal channels. The transverse channels are formed exclusively as open grooves at at least one end face. The open grooves can be formed by projections on the injection mold halves, and the longitudinal channels by peg-like extensions. Said peg-like extensions could, where appropriate, be formed by sliders in the longitudinal direction, which are relatively easily realizable. Nevertheless, in this embodiment, no cross-slides are required. Cross-slide free means that there are no slides whose movement direction is transverse to the demolding direction of the injection mold halves.

If transverse channels are provided on the end face facing the first housing part, said channels are closed by the diaphragm or one of the diaphragms.

If transverse channels are formed in the second housing part on the end face opposite the first housing part, it is appropriate to use a third housing part. Said third housing part adjoins said opposite end face and separates the channels for dosing fluid or transverse channels in the second housing part from the third housing part through an elastic seal placed in between so as to close them outwardly. Accordingly, the third housing part also does not come into contact with the dosing fluid and need not be co-exchanged when the dosing unit is charged with another dosing fluid.

The pump chamber can have a back wall facing the diaphragm and defining a part of the pump chamber. The diaphragm can contact the back wall when the pump chamber is drained, under which also a nearly completely drained pump chamber falls. The back wall has at least one indentation that is open to the pump chamber and that is fluidly connected with the pump channel supplying the pump fluid. However, in the case of a drained pump chamber, under which, as mentioned, also a nearly drained pump chamber falls, the diaphragm is spaced apart from the surface forming the indentation, although it otherwise lies flat against the back wall. This embodiment prevents that the diaphragm, when it contacts the back wall, sticks to said wall. A sticking of the diaphragm to the back wall would lead to a strong positive pressure first having to be built up in the pump channel supplying the pump fluid so as to release the diaphragm from the back wall again. However, the pressure is immediately distributed in the region of the back wall via the indentations such that the pressure of the pump fluid is distributed uniformly across sections of the back wall, and the diaphragm releases again from the back wall quickly and without delay.

In this context, there are preferably multiple open indentations in the back wall merging into each other to form a kind of branched groove system.

The present invention provides that there is at least one overflow channel between a dosing fluid inlet and a dosing fluid outlet of the dosing chamber. The overflow channel fluidly connects the dosing fluid inlet and the dosing fluid outlet independently of the position of the diaphragm. In previous dosing units, a sudden pressure drop could occur in the drain channel that starts from the dosing chamber upon expelling the pressure fluid. This would cause the diaphragm to be abruptly pressed onto the drain channel opening which opening starts from the dosing chamber, such that the drain channel was unintentionally closed although there was still dosing fluid in the dosing chamber. This could lead to a slightly fluctuating dosing amount. To increase the dosing precision still further, the overflow channel ensures that the dosing fluid inlet and outlet are interconnected, always and independently of the position of the diaphragm such that, also in the event of a sudden pressure drop in the drain channel, the dosing fluid located in the feed channel downstream of the diaphragm valve can drain off. This also means that said overflow channel always fluidly connects the dosing space with the drain channel for dosing fluid, independently of the position of the diaphragm.

The overflow channel can be formed as an open groove in the back wall of the dosing chamber in the second housing part.

The dosing fluid inlet and the dosing fluid outlet could be interconnected by an overflow channel that connects them by the shortest path and/or by at least one overflow channel extending at the edge of the dosing chamber. Preferably there is an overflow channel both at the edge of the dosing chamber and across the dosing chamber.

To adjust the volume of the pump chamber and thus the volume of the pump, a back wall facing the diaphragm can be displaceable such that its distance from the diaphragm can be changed.

The pump chamber and/or the dosing chamber each have a back wall facing the diaphragm, at least one of the back walls being convexly or concavely arched. The concave arch increases the volume of the respective chamber, and the convex formation reduces, in the event of negative pressure in the respective chamber, the contact surface between the diaphragm and the back wall, such that the adhesive force between the adjacent diaphragm and the back wall is lower than in the case of a concave back wall. By providing second housing parts having differently shaped back walls, it is possible to change the dosing unit with respect to the dosing amount with identical first housing parts.

A simple embodiment provides that the cavity is formed exclusively in the first housing part. In this way, in the level position of the diaphragm, no volume results for the dosing space, said volume is formed only when the diaphragm is pulled into the cavity in the first housing part. In this way, it is possible to form the second housing part from a flat plate, which entails a cost reduction in terms of production.

Furthermore, the present invention also relates to a pneumatic dosing system having a dosing unit according to the present invention and at least one additional second housing part that is structurally identical to the second housing part already coupled to the first housing part, the coupled second housing part being non-destructively releasable from the first housing part. The dosing system according to the present invention consequently provides for interchangeable parts such that multiple second housing parts are available as disposable parts. The dosing system permits an exchange of the second housing part with a new, non-determined second housing part without destroying the first housing part or a fastening part.

In this context, it is advantageous when the diaphragm in the cavity and/or the diaphragm of the diaphragm valves are preassembled on the second housing part and are fastened to same, such that the one or more diaphragms continue to keep the cavity and the channels in the second housing part closed when the second housing part is changed and no medium is discharged.

DETAILED DESCRIPTION

Figure 1:
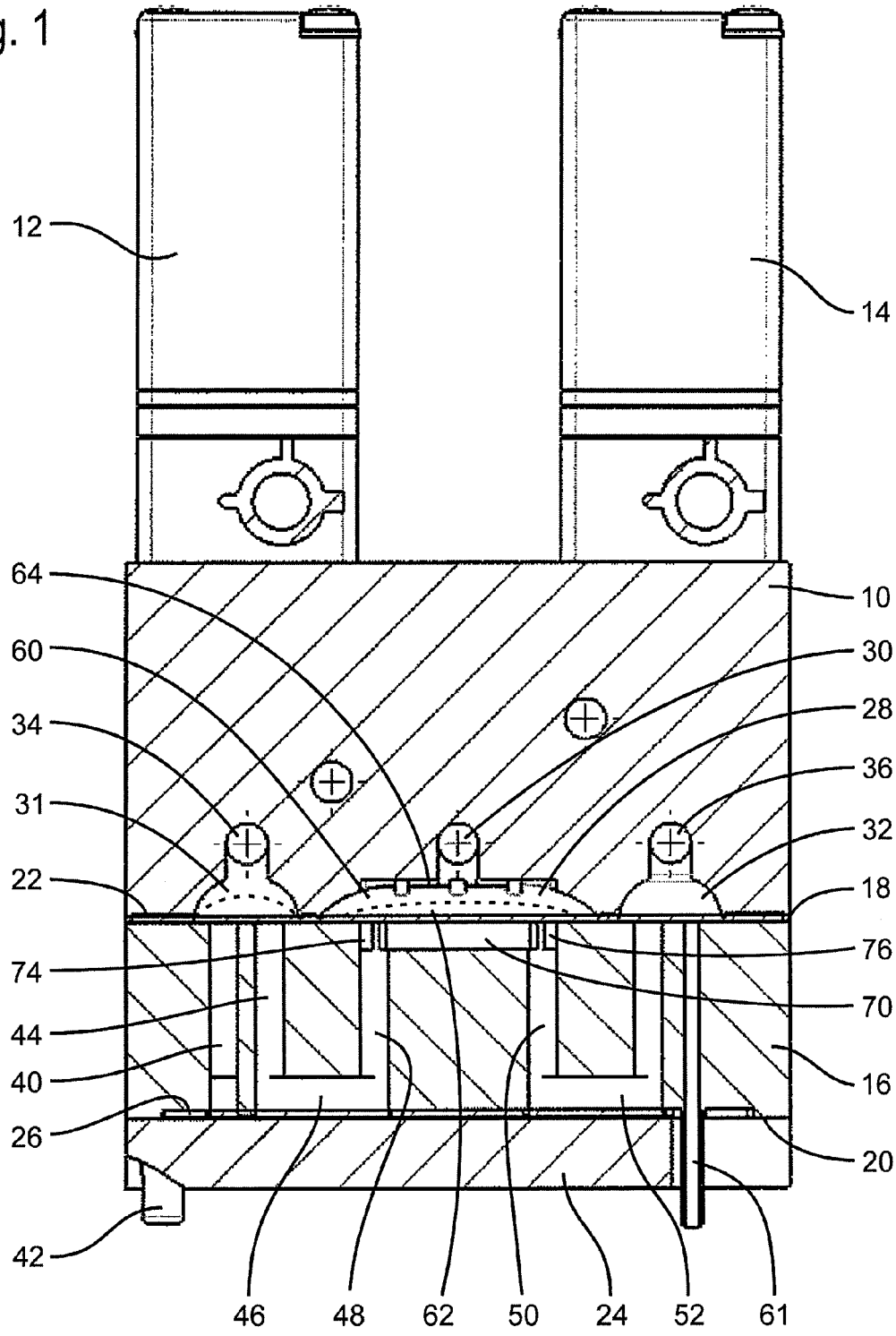
FIG. 1 shows a perspective view of a longitudinal section taken through a first embodiment of the dosing unit according to the present invention that is part of the dosing system according to the present invention.

In FIG. 1 a pneumatic dosing unit is depicted that is used, among other things, for dosing high-quality fluids, for example in the pharmaceuticals sector. Here, fluid flows are moved through the dosing unit and the expelled fluid amount of said fluids is determined precisely.

The dosing unit has a multipart housing, having a first housing part 10 that is executed, for example, as a square and to which multiple pneumatic valves 12, 14 are fastened.

Adjoining the first housing part is a second housing part 16 that is formed, for example, to be plate shaped, and exhibits an end face 18 facing the first housing part 10, and an opposite end face 20. Between the first and the second housing parts 10 and 16 a diaphragm 22 is clamped that preferably extends across the entire end face 18 and covers said end face with respect to the opposing end face at the first housing part 10.

A third housing part 24 is provided at the end face 20, a flat, elastic seal 26 being clamped here in sections between the second and the third housing parts 16 and 24, respectively.

The individual housing parts 10, 16, 24 have different functions.

The first housing part 10 is provided for the flow of so-called pump fluid, here preferably air in each case, that is controlled via the valves 12, 14.

For this, pump channels and control channels are formed in the first housing part 10 that are explained in greater detail below.

Between the first and second housing parts 10 and 16, respectively, a cavity 28 is provided that, in the embodiment depicted in FIG. 1, is formed by a dome-shaped indentation at the first housing part's end face 18 facing the second housing part 16.

The diaphragm 22 is located in said cavity 28. One or more pump channels 30 in the first housing part 10 lead to and flow into the cavity 28. Said pump channels can start from or open into one of the valves 12, 14 to allow the pump fluid to enter into or be discharged from the cavity 28 in a controlled manner.

Laterally spaced apart from the cavity 28 further cavities 31, 32 are provided in the first housing part 10 that are each a part of a diaphragm valve. At least one control channel 34, 36 opens into each of the cavities 31, 32. Here, too, a channel supplying pump fluid and discharging pump fluid, that is, two channels per cavity 31, 32, can be provided. The control channel(s) 34, 36 lead to or come from one or more valves 12, 14.

Feed and drain channels for the dosing fluid are provided in the second housing part 16. The spaces and channels limiting the dosing fluid are formed exclusively in the second housing part 16 such that the dosing fluid cannot come into contact with the first housing part 10.

A feed channel 40 for dosing fluid in the second housing part 16 is connected with an inlet nozzle 42 that protrudes downwardly from the end face 20 through an opening in the third housing part 24. The feed channel 40 has multiple sections. A first section, which is closest to the nozzle 42, leads from the end face 20 preferably vertically to the end face 18 and adjoins the diaphragm 22. A second section 44 of the feed channel 40 extends in the opposite direction, that is, parallel to the first section, spaced only slightly apart therefrom. Both sections have, at the end face 18, their orifice in the region that faces the cavity 31.

If the diaphragm 22 does not buckle upward, but rather is flat or buckles slightly downward, that is, in the direction of the second housing part 16, it closes the two sections of the feed channel 40 such that the diaphragm valve formed in this way is closed. If, in contrast, a negative pressure is produced in the cavity 31 by outflowing pump fluid, the diaphragm 22 in the region of the cavity 31 will bulge into the cavity 31 such that the two sections of the feed channel 40 are fluidly connected with each other. The partially opened valve is symbolized in FIG. 1 with dotted lines.

The feed channel 40 has, downstream of the second section 44, a transverse channel 46 at the end face 20 that is formed by a groove that is open to the end face 20. Said groove is closed by the seal 26. The effect of seal 26 is that no dosing fluid comes into contact with the third housing part 24. After the transverse channel 46 another section is provided, again preferably extending vertically to the end faces 18, 20, that in turn ends at the front face 18. Here the section 48 of the channel 40 ends in the region of the cavity 28.

Laterally spaced apart from the section 48 the so-called drain channel 50 begins, having sections that extend vertically to the end faces 18, 20 and at least one transverse channel 52 connecting said sections. In the drain channel 50 also a diaphragm valve sits that is formed in the region of the cavity 32. Further details are dispensed with, since the structure of said valve is designed in accordance with the structure of the valve in the cavity 31.

The drain channel 50 ends in a drain nozzle 61 that extends, for example, downward as a pipe through a recess in the third housing part 24.

The cavity 28 forms a kind of pump, the diaphragm 22 dividing the cavity 28 into two chambers, specifically a pump chamber 60 that, with respect to the diaphragm 22, lies on the side of the diaphragm facing the first housing part, and a dosing chamber 62 provided on the opposite side of the diaphragm 22.

If the diaphragm 22 lies fully flat against the end face 18, the volume of the dosing chamber 62 will be zero or nearly zero, so not discernible in the drawing. If, however, a negative pressure is produced in the facing pump chamber 60, the diaphragm 22 arches in this region farther or less far upward (see dotted lines in FIG. 1) such that the volume of the dosing chamber 62 increases continuously and that of the pump chamber 60 decreases accordingly. The diaphragm 22 can be deformed to the extent that it lies fully flat against the so-called back wall 64 in the first housing part 10 that faces the diaphragm 22. Then the volume of the pump chamber 60 is zero or nearly zero and that of the dosing chamber 62 at the maximum.

The diaphragm 22 is pulsatingly deformed and relaxed again in the region of the cavity 28, which occurs through buildup of pressure and/or buildup of negative pressure in the pump chamber 60. The diaphragm valves in the feed channel 40 and in the drain channel 50 are actuated in a frequency coordinated in accordance with said pump frequency such that, when the feed channel 40 is opened and the drain channel 50 closed and the diaphragm 22 arching upward, via the nozzle 42, dosing fluid is drawn in that subsequently, after the feed channel 40 is closed and the drain channel 50 opened and the diaphragm 22 moving downward, is expelled from the dosing system again via the drain nozzle 61.

As is apparent from FIG. 1 that the pump and control channels 30, 34, 36 are formed in the first housing part, and indeed exclusively therein, and the dosing-fluid-conducting channels 40, 50 are formed exclusively in the second housing part.

The third housing part 24 is preferably provided without a fluid conducting channel and forms only a kind of cap.

Although, optionally, multiple diaphragms can be provided between the first and the second housing part 10 and 16 to close the cavity 28 and the cavities 31, 32, in the depicted embodiment, there is one shared, i.e. common diaphragm 22.

The second housing part 16 is optimized in terms of manufacturing technology. There are exclusively channels that either extend vertical to the end faces 18, 20 and begin at one end face and end at the opposite end face. Said channels are called longitudinal channels. The other form of channels are so-called transverse channels. Said transverse channels extending transversely to the longitudinal channels always extend at the end faces 18 and/or 20 and are formed as outwardly open grooves that are closed only by the diaphragm 22 or the seal 26.

Said structure of the channels allows to produce the second housing part 16 as an injection molded part, preferably composed of plastic. Said injection molded part can be manufactured without cross slides since, in the demolding direction (here in the direction of the longitudinal channel), it is provided without undercuts since the transverse channels end openly outside at the end faces 18, 20.

A distinctive feature of the dosing unit is one or multiple overflow channels 70, 72 that fluidly interconnect the so-called dosing fluid inlet 74 at the end of the feed channel 40 to the dosing chamber 62 and the so-called dosing fluid outlet 76 of the dosing chamber 62. The dosing fluid outlet 76 is, so to speak, the beginning of the outlet channel 50. It is apparent in FIG. 2 that said overflow channel 70 is only a relatively narrow channel that connects the dosing fluid inlet 74 with the dosing fluid outlet 76 by the shortest path. Also the overflow channel 70 formed as a transverse channel is formed as an open groove that, here, is a indentation in the end face 18.

Figure 2:
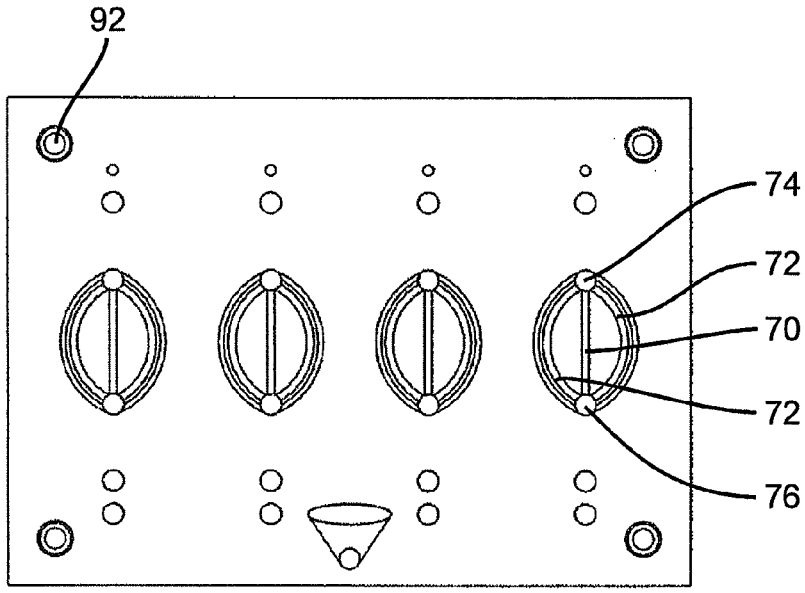
FIG. 2 shows a top plan view of the contact surface of the second housing part with which said second housing part lies against the diaphragm.

Additionally or alternatively to this arcuately extending further overflow channels 72 are provided in the second housing part 16 at the edge of the dosing chamber 62 (see FIG. 2). These overflow channels also connect the dosing fluid inlet 74 with the dosing fluid outlet 76.

For all overflow channels 70, 72, it applies that they are open also when the diaphragm 72 presses against the second housing part 16 to the maximum extent. In this way it is ensured that, in the event of a sudden outlet-side pressure drop, the dosing fluid located in the feed channel 40 downstream of the diaphragm valve in the second housing part 16 can flow out. The dosing chamber 62 is thus always completely drained, leading to a high dosing precision.

The end face 18 in the region between the overflow channel 70 and each of the two adjoining overflow channels 72 is, apart from that, flat, which, however, is not to be understood as limiting.

Figure 3:
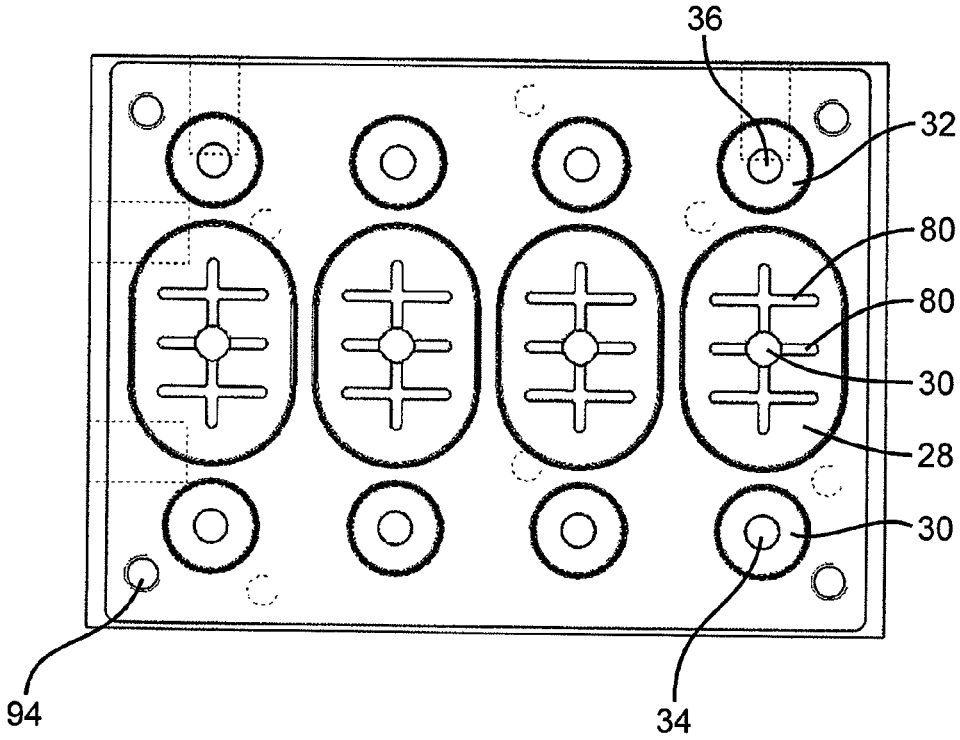
FIG. 3 shows a top plan view of the contact surface of the first housing part with which said first housing part lies against the diaphragm.
Figure 4:
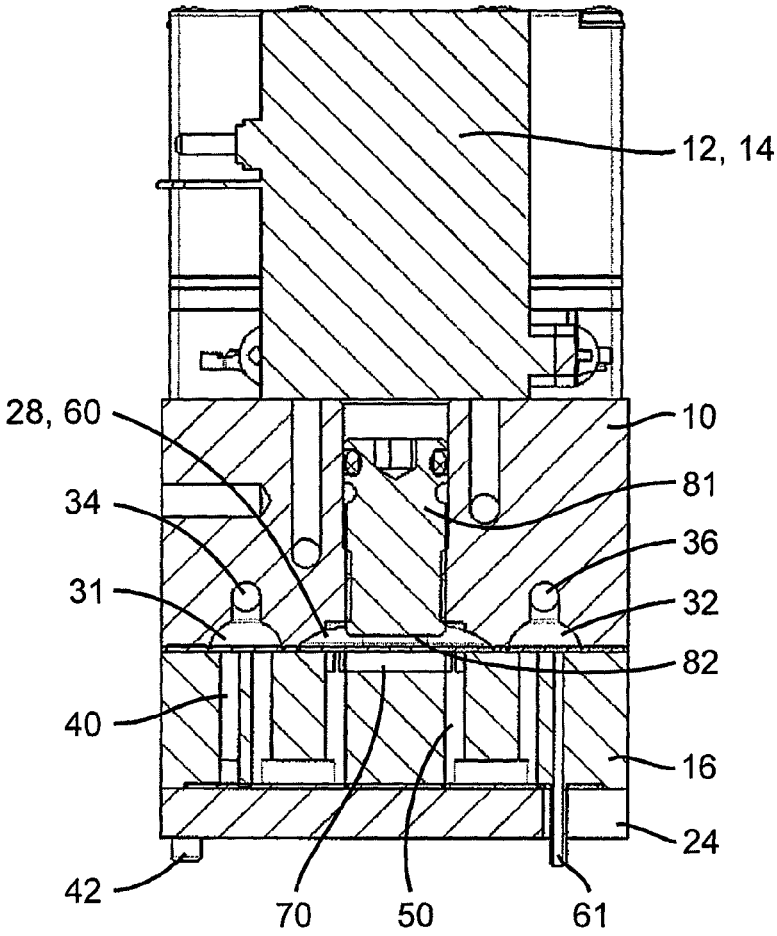
FIG. 4 shows a perspective view of a longitudinal section taken through a second embodiment of the dosing unit according to the present invention that is part of the dosing system according to the present invention.

The back wall 64, which in the depicted embodiment is exemplarily formed in a dome shape, which is not to be understood as limiting, additionally has indentations 80 that are open to the pump chamber 60 (see FIG. 3). Said indentations are preferably groove-shaped and merge into each other such that, for example, a kind of net or cross shape results. All indentations 80 are fluidly connected with the pump channel 30.

Even if the diaphragm 22 lies flat against the back wall 64, the indentations 80 are not filled by the diaphragm 22. Thus, when the diaphragm 22 is to be moved back to its starting position according to FIG. 1, pump fluid will then apply at the diaphragm 22 distributed relatively uniformly and across a large surface. In this way, the diaphragm can also actively be quickly released from the back wall 64.

As is apparent from FIGS. 2 and 3, multiple identical dosing units provided side by side are formed in the same housing such that it is possible to work with a single diaphragm 22 for multiple dosing units. In the embodiment shown, four dosing units are provided side by side, which, however, is not to be understood as limiting the distinctive features of the embodiment according to FIG. 1.

The embodiments explained below correspond to those mentioned previously such that, for functionally identical parts, the already established reference signs could be adopted and only the differences need be addressed below.

In the case of the embodiment according to FIG. 3, the distinctive feature consists in that at least one section of the back wall 64 in the first housing part 10 can be displaced. Here, a threaded bolt 81 is screwed in whose front face 82 forms a part of the back wall 64. The threaded bolt 81 can be screwed farther or less far into the cavity 28 such that the volume of the cavity and the lift of the diaphragm 22 permit infinitely variable control.

In the exemplary embodiment shown, the front face 82 is flat, but it can also be convex or concave. The corresponding pump channel flowing into the pump chamber 60 is provided laterally to the threaded bolt 81 in the first housing part 10 (not shown).

Figure 5:
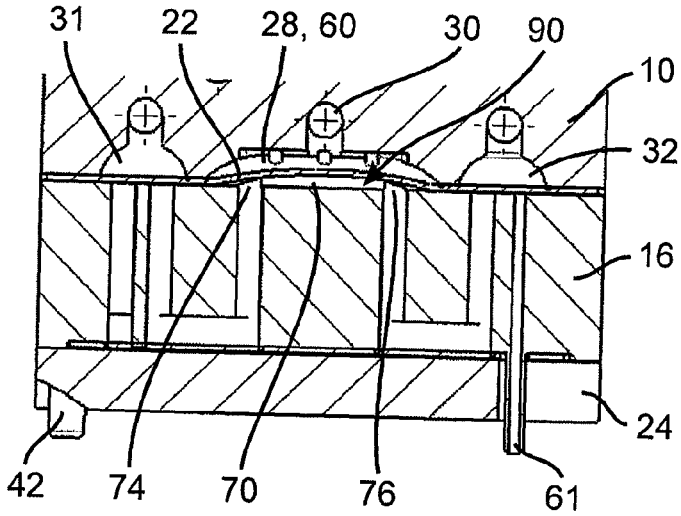
FIG. 5 shows a perspective view of a longitudinal section taken through a part of a third embodiment of the dosing unit according to the present invention that is likewise part of the dosing system according to the present invention.

In the embodiment according to FIG. 5, the second housing part 16 has, in the region of the dosing chamber 62, a convex projection that forms a convex back wall 90.

In the position according to FIG. 5, the diaphragm 22 lies fully flat against the back wall 90 of the second housing part 16, a gap being provided only in the region of the overflow channel 70.

In all embodiments, it applies that the second housing part 16 is preferably provided as an injection molded part, having the previously mentioned transverse channels extending openly at the end faces and having the corresponding longitudinal channels between the end faces. All second housing parts 16 can also be manufactured without usage of cross slides by injection molding.

The cavity 28 is preferably exclusively formed in the first housing part 10, this not being understood to be limiting.

For an optimum diaphragm service life, it will be favorable if the pump volume is divided between the first and the second housing part 10, 16 such that one part of the indentation each is formed in both housing parts 10, 16. In this way, the diaphragm is stretched less heavily.

The depicted dosing units permit a quick, simple exchange of the second housing part 16 for a structurally identical replacement housing part if the second housing part was already used for a dosing operation with one dosing fluid and if another dosing fluid is to flow through the dosing unit. Then, for example, simply screw and clamp connections (see openings 92 or threads 94 in FIGS. 2 and 3) need to be unfastened, which is done non-destructively. Then the second housing part 16 is simply exchanged for a fresh second housing part 16, the diaphragms 22, 26 being fastened to the second housing part 16 and being co-exchanged.

The dosing unit is preferably not delivered alone, but rather at least with an additional second housing part that is defined as a structurally identical replacement part. Preferably, there are considerably more than two replacement housing parts. In this way, a pneumatic dosing system results. If the back walls of the second housing parts have different geometries, different dosing amounts can be set by replacing the second housing parts 16, which makes the dosing system variable.

The diaphragm 22 is preferably preassembled on the second housing part 16, for example through flanging, vulcanizing on or bonding at the edge such that the diaphragm 22 does not come loose and is inadvertently remounted inversely. Optionally also the seal 26 can be preassembled, for example on the second housing part 16.

The invention claimed is:

1. A pneumatic dosing unit, comprising:

a multipart housing having a first housing part in which at least one pump-fluid receiving pump channel is formed, and a second housing part in which dosing-fluid receiving channels comprising at least one feed channel and at least one drain channel are formed;

a cavity formed between the first housing part and the second housing part;

a flexible diaphragm clamped between the first housing part and the second housing part and dividing the cavity into a pump chamber and a dosing chamber that are fluidically separated from each other;

at least one feed channel and at least one drain channel in the second housing part leading to the dosing chamber and starting from the dosing chamber, respectively;

diaphragm valves in the feed channel and in the drain channel that are spaced apart from the associated pump chamber and the associated dosing chamber, and wherein the diaphragm valves in the feed channel and in the drain channel are controllable via control channels in the first housing part;

one of the diaphragm valves being arranged upstream and one of the diaphragm valves being arranged downstream of the feed channel and the drain channel; and the flexible diaphragm and the diaphragm valves being arranged in such a way that dosing fluid does not contact the first housing part, wherein the second housing part is an injection molded part able to be manufactured without cross slides, wherein the second housing part has two opposing end faces, the first housing part facing one of the two opposing end faces, wherein the second housing part having longitudinal channels leading from one end face to an opposite end face and having transverse channels connecting the longitudinal channels, wherein the transverse channels are exclusively formed by an open groove at at least one of the two opposing end faces, and wherein a third housing part is provided adjoining one of the two opposing end faces of the second housing part which is opposite to the flexible diaphragm, the third housing part being fluidically separated from the dosing-fluid receiving channels in the second housing part by an elastic seal.

2. A pneumatic dosing unit, comprising:

a multipart housing having a first housing part in which at least one pump-fluid receiving pump channel is formed, and a second housing part in which dosing-fluid receiving channels comprising at least one feed channel and at least one drain channel are formed;

a cavity formed between the first housing part and the second housing part;

a flexible diaphragm clamped between the first housing part and the second housing part and dividing the cavity into a pump chamber and a dosing chamber that are fluidically separated from each other at least one feed channel and at least one drain channel in the second housing part leading to the dosing chamber and starting from the dosing chamber, respectively;

diaphragm valves in the feed channel and in the drain channel that are spaced apart from the pump chamber and the dosing chamber and, wherein the diaphragm valves in the feed channel and in the drain channel are controllable via control channels in the first housing part; and the flexible diaphragm and the diaphragm valves being arranged in such a way that dosing fluid does not contact the first housing part, wherein the dosing chamber has a dosing fluid inlet and a dosing fluid outlet, and wherein at least one overflow channel fluidly connecting the dosing fluid inlet and the dosing fluid outlet independently of the position of the flexible diaphragm is arranged between the dosing fluid inlet and a dosing fluid outlet.

3. The dosing unit according to claim 2, wherein the first housing part comprises: at least one of one or more pump channels and control channels.

4. The dosing unit according to claim 2, wherein the flexible diaphragm separating the pump and the dosing chamber from each other also defines the flexible diaphragm of at least one diaphragm valve among the diaphragm valves in the feed channel and in the drain channel.

5. The dosing unit according to claim 2, wherein the pump chamber has a back wall facing the flexible diaphragm, the flexible diaphragm contacting the back wall when the pump chamber is drained, the back wall having at least one indentation being open to the pump chamber, the indentation being connected with the pump channel conducting pump fluid, and the flexible diaphragm being spaced apart from a surface forming the indentation when the pump chamber is drained.

6. The dosing unit according to claim 5, wherein a plurality of open indentations merging into each other are provided in the back wall.

7. The dosing unit according to claim 2, wherein the at least one overflow channel connecting the dosing fluid inlet and the dosing fluid outlet by a shortest path and the at least one overflow channel running at the edge of the dosing chamber is provided.

8. The dosing unit according to claim 2, wherein the pump chamber and the dosing chamber each have a back wall facing the flexible diaphragm, at least one of the back walls being arched one of convexly and concavely.

9. The dosing unit according to claim 2, wherein the cavity is formed exclusively in the first housing part.

10. The dosing unit according to claim 2, wherein the dosing chamber is opened and closed in a certain frequency to dose the fluid.

11. A pneumatic dosing unit, comprising:

a multipart housing having a first housing part in which at least one pump-fluid receiving pump channel is formed, and a second housing part in which dosing-fluid receiving channels comprising at least one feed channel and at least one drain channel are formed;

a cavity formed between the first housing part and second housing part;

a flexible diaphragm clamped between the first housing part and the second housing part and dividing the cavity into a pump chamber and a dosing chamber that are fluidically separated from each other;

at least one feed channel and at least one drain channel in the second housing part leading to the dosing chamber and starting from the dosing chamber, respectively;

diaphragm valves in the feed channel and in the drain channel that are spaced apart from the pump chamber and the dosing chamber and, wherein the diaphragm valves in the feed channel and in the drain channel are controllable via control channels in the first housing part; and the flexible diaphragm and the diaphragm valves being arranged in such a way that dosing fluid does not contact the first housing part, wherein the pump chamber has an adjustable and displaceable back wall facing the flexible diaphragm, the distance of the back wall to the flexible diaphragm being adjustable to change a pump volume.

* * * * *